US008031146B2

(12) United States Patent
Park et al.

(10) Patent No.: US 8,031,146 B2
(45) Date of Patent: Oct. 4, 2011

(54) DATA DRIVER DEVICE AND DISPLAY DEVICE FOR REDUCING POWER CONSUMPTION IN A CHARGE-SHARE OPERATION

(75) Inventors: Jun-Hong Park, Seoul (KR); Si-Wang Sung, Suwon-si (KR); Hee-Sook Choi, Incheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1087 days.

(21) Appl. No.: 11/829,469

(22) Filed: Jul. 27, 2007

(65) Prior Publication Data

US 2008/0170057 A1 Jul. 17, 2008

(30) Foreign Application Priority Data

Jan. 16, 2007 (KR) ..... 10-2007-0004868

(51) Int. Cl.
*G09G 5/00* (2006.01)

(52) U.S. Cl. ..... 345/87; 345/100

(58) Field of Classification Search ..... 345/87, 345/100
See application file for complete search history.

(56) References Cited

U.S. PATENT DOCUMENTS

| | | | | |
|---|---|---|---|---|
| 6,628,274 | B1 * | 9/2003 | Morita | 345/209 |
| 2007/0285412 | A1 * | 12/2007 | Yoon-Kyung | 345/211 |

FOREIGN PATENT DOCUMENTS

| | | | |
|---|---|---|---|
| CN | 1888952 | | 1/2007 |
| JP | 2000-284754 | | 10/2000 |
| JP | 2002-099261 | | 4/2002 |
| JP | 2003-330429 | | 11/2003 |
| KR | 1020030004988 | A | 1/2003 |
| KR | 1020050106901 | A | 11/2005 |
| KR | 1020060119749 | | 11/2006 |

* cited by examiner

*Primary Examiner* — Richard Hjerpe
*Assistant Examiner* — Jeffrey Steinberg
(74) *Attorney, Agent, or Firm* — F. Chau & Associates, LLC

(57) ABSTRACT

A data driver device and a display device, in which the data driver device includes a plurality of data lines; a plurality of first charge-share switches connected between a share line and the plurality of data lines, respectively; and a plurality of second charge-share switches each connected between two adjacent data lines among the plurality of data lines.

13 Claims, 6 Drawing Sheets

DATA DRIVER DEVICE AND DISPLAY DEVICE FOR REDUCING POWER CONSUMPTION IN A CHARGE-SHARE OPERATION

CROSS-REFERENCE TO RELATED PATENT APPLICATION

This application claims priority under 35 U.S.C. §119 from Korean Patent Application No. 10-2007-0004868, filed on Jan. 16, 2007, the disclosure of which is hereby incorporated by reference herein in as if set forth in its entirety.

FIELD OF THE INVENTION

The present disclosure relates to a semiconductor device and, more particularly, to a data driver device and display device for reducing power consumption of charge-share switches during charge-share of a display panel.

BACKGROUND OF THE INVENTION

With the development of semiconductor technology, display devices tend to have a large size in order to satisfy the consumers' demand. As a display device becomes large, the load of a display panel, for example, a liquid crystal display (LCD) panel, increases. Source lines or data lines in the display panel are driven by a data (or source) driver device.

When a display device, for example, an LCD television (TV), becomes large, a load resistor, for example, a source line resistor, of a display panel, for example, an LCD panel, is manufactured with a decreased value in order to reduce power consumption of the display panel. On the other hand, when the display device becomes large, the load capacitance, for example, source line capacitance, of the display panel is increased.

When the value of the load resistor of the display panel is decreased and the load capacitance of the display panel is increased, the power consumed in the data driver device to drive the source lines of the display panel increases, causing a considerable amount of heat to be generated in the data driver device. More specifically, power consumption increases significantly in charge-share switches included in an output circuit of the data driver device.

FIG. 1 illustrates an output circuit 100 of a conventional data driver device. Referring to FIG. 1, the output circuit 100 includes a plurality of output terminals 111 through 11*n*. The output terminals 111 through 11*n* respectively receive gray voltages V1 through Vn and output them to source lines S1 through Sn, respectively of a display panel (not shown) to respectively drive the source lines S1 through Sn.

Each of the output terminals 111 through 11*n* includes a respective amplifier 121 through 12*n*, a data line switch T1 through Tn, a charge-share switch H1 through Hn, and an output pad PAD1 through PADn. Each of amplifiers 121 through 12*n* respectively included in the output terminals 111 through 11*n* amplifies a corresponding gray voltage V1 through Vn output from a digital-to-analog converter (DAC) (not shown) is of the data driver device and outputs the respective amplified gray voltage V1 through Vn. When the data driver device drives source lines in the display panel using a dot inversion method or a source line inversion method, an odd numbered gray voltage, for example, V1, and an even numbered gray voltage, for example, V2 which are adjacent each other among the gray voltages V1 through Vn, have opposite polarities.

The first data line switch T1 of the first output terminal 111 is switched in response to a first control signal P1 and a first inversion control signal PB1, so that an output of the first amplifier 121 is transmitted to the first source line S1 of the display panel via the first output pad PAD1. Charge-share switches H1 through Hn are connected between a share line Sh and data line switches T1 through Tn, respectively. The charge-share switches H1 through Hn are switched in response to a second control signal P2 and a second inversion control signal PB2. When the data line switches T1 through Tn are turned off the charge-share switches H1 through Hn are turned on.

When the charge-share switches H1 through Hn are turned on, the source lines S1 through Sn in the display panel are connected with one another via the share line Sh, so that charges are distributed to a plurality of cells in the display panel. As a result, the source lines S1 through Sn share a source line voltage, that is, a charge-share voltage after the completion of the charge distribution. At this time, the share line Sh has the charge-share voltage.

FIG. 2 illustrates a pair of the adjacent output terminals, such as 111 and 112 illustrated in FIG. 1, and loads LOAD1 and LOAD2 respectively corresponding to the adjacent output terminals 111 and 112 in a display panel (not shown). Only one pair of the output terminals, such as 111 and 112, are illustrated in order to clearly describe power consumed by charge-share switches, for example, H1 and H2, of the data driver device when the display panel is charge shared. Each of the loads LOAD1 and LOAD2 is modeled of the resistance and capacitance of each of the source lines S1 and S2.

Referring to FIG. 2, when the display panel is charge shared, the data line switches T1 and T2 are turned off and the charge-share switches H1 and H2 are turned on. When the first gray voltage V1 is a positive voltage and the second gray voltage V2 is a negative voltage, a voltage of the first source line S1 is greater than that of the second source line S2. Accordingly, when the display panel is charge shared, a share current Is flows from the first source line S1 to the second source line S2 via the charge-share switches H1 and H2, as illustrated in FIG. 2. For the share current Is illustrated in FIG. 2, only the charge-share between the first source line S1 and the second source line S2 has been considered. When all of the source lines S1 through Sn in the display panel are considered, the share current Is may have a different value.

When a load resistance of a source line in a display panel decreases and a load capacitance of the source line increases, power consumption due to a share current in charge-share switches increases considerably. As a result, heat generation in a data driver device may also be increased. Accordingly, it is desired to reduce power consumed in the charge-share switches in an output circuit of the data driver device when the source lines in the display panel are charge shared.

SUMMARY OF THE INVENTION

Exemplary embodiments of the present invention provide a data driver device and display device for reducing power consumption in charge-share switches when a display panel is charge shared.

According to exemplary embodiments of the present invention, there is provided a data driver device including a plurality of data lines, a plurality of first charge-share switches, and a plurality of second charge-share switches. The plurality of first charge-share switches are connected between a share line and the plurality of data lines, respectively. Each of the plurality of second charge-share switches is connected between two adjacent data lines among the plurality of data lines.

According to exemplary embodiments of the present invention, there is provided a data driver device including a plurality of output terminals. Each of the output terminals includes a data line that outputs a corresponding gray voltage among a plurality of gray voltages to a corresponding source line among a plurality of source lines included in a display panel. At least one electrical path may be formed between two adjacent data lines among the plurality of data lines while the source lines are charge shared.

According to exemplary embodiments of the present invention, a display device includes a display panel, a gate driver block, and a source driver block. The display panel includes a plurality of gate lines, a plurality of source lines, and a plurality of pixels disposed at intersections between the gate lines and the source lines. The gate driver block drives the gate lines. The source driver block includes a plurality of data driver devices. The data driver devices drive the source lines. Each of the data driver devices may include a digital-to-analog converter block and an output circuit. The digital-to-analog converter block outputs a plurality of gray voltages based on a digital image data signal. The output circuit may include a plurality of data lines, a plurality of first charge-share switches, and a plurality of second charge-share switches. The plurality of first charge-share switches may be connected between a share line and the plurality of data lines, respectively. Each of the plurality of second charge-share switches may be connected between two adjacent data lines among the plurality of data lines.

BRIEF DESCRIPTION OF THE DRAWINGS

Exemplary embodiments of the present invention will be understood in more detail from the following descriptions taken in conjunction with the attached drawings, in which.

DETAILED DESCRIPTION OF EXEMPLARY EMBODIMENTS

Figure 1:
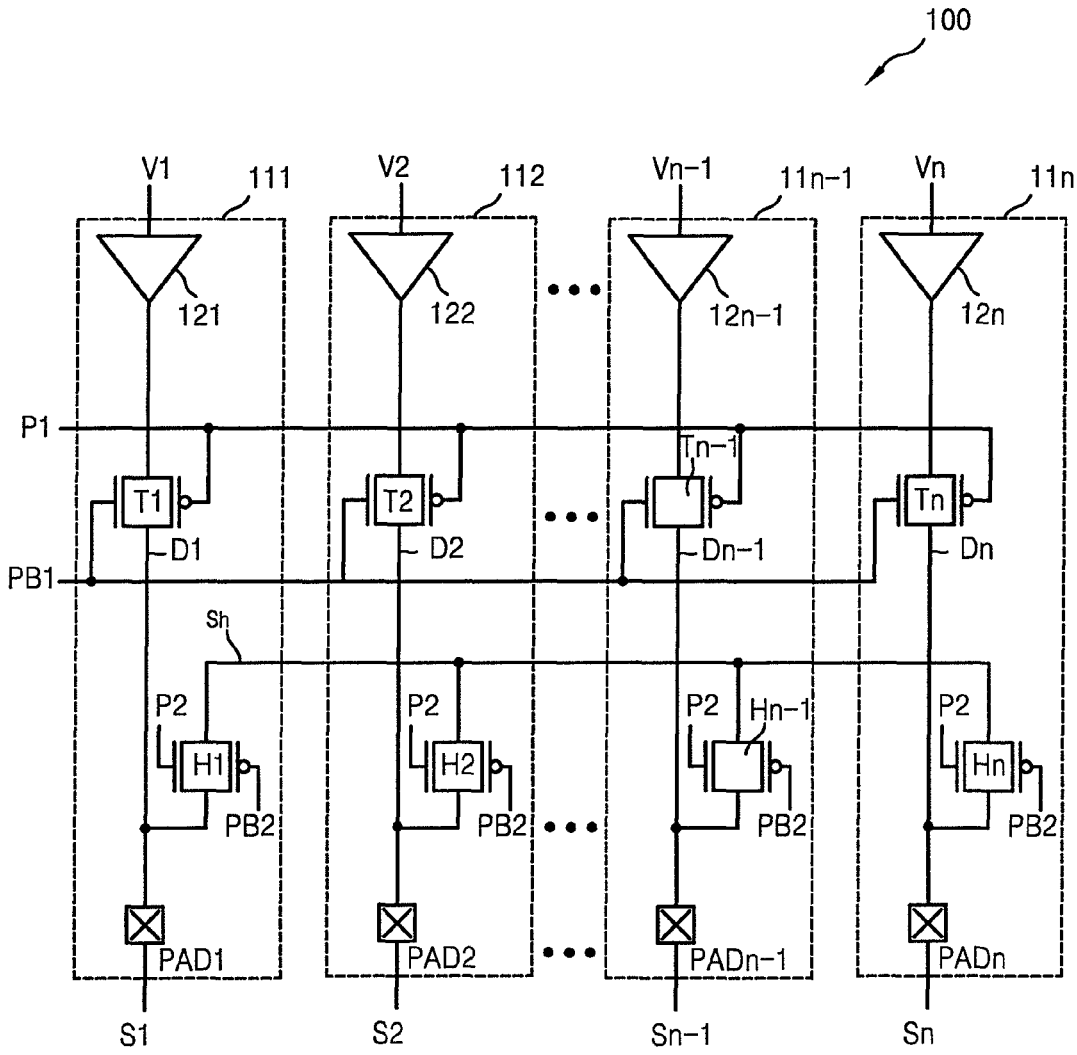
FIG. 1 (CONVENTIONAL ART)
FIG. 1 illustrates an output circuit of a conventional data driver device.

Exemplary embodiments of the present invention now will be described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the invention to those of ordinary skill in the art. In the drawings, like numbers refer to like elements throughout.

Figure 3:
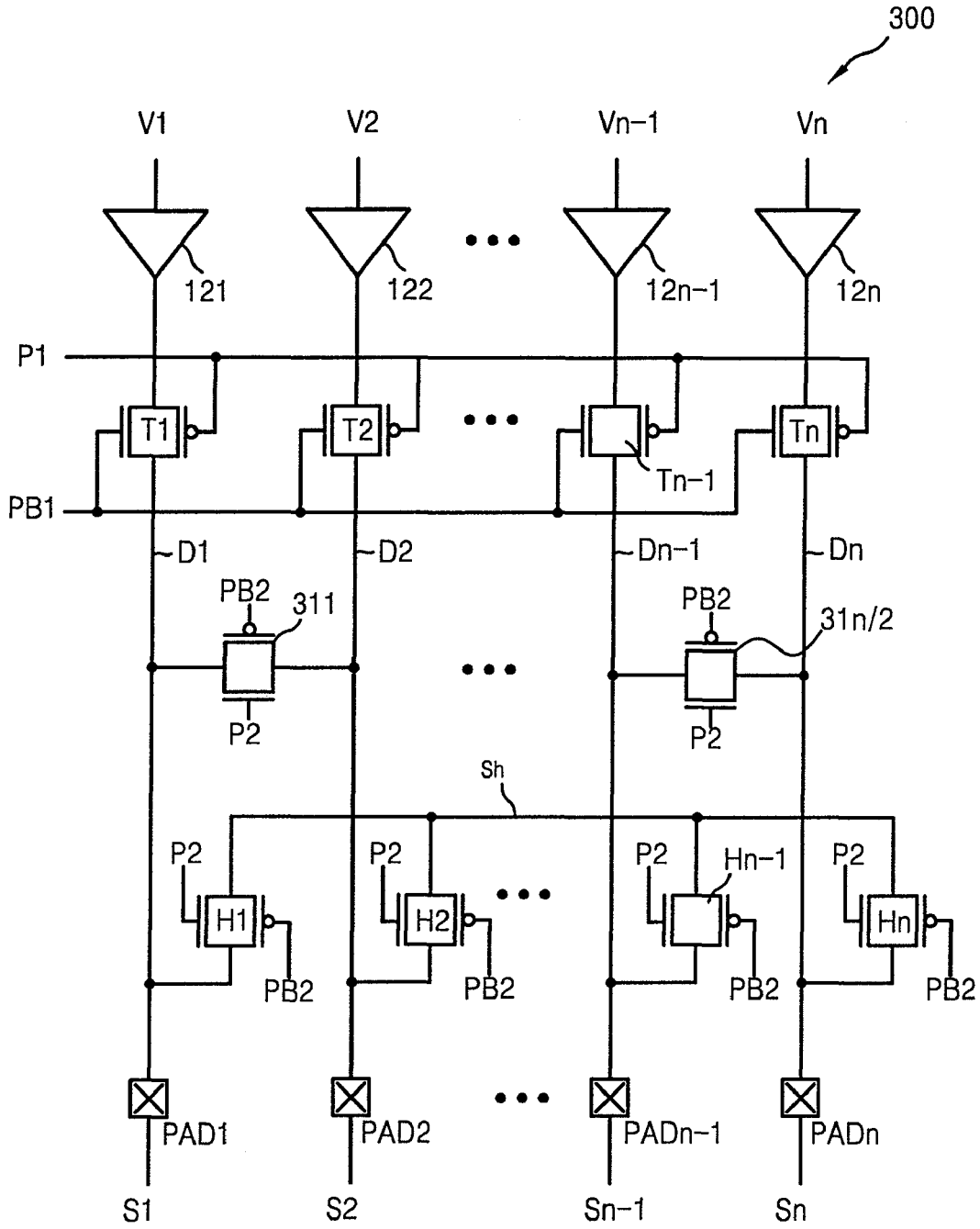
FIG. 3 illustrates an output circuit according to exemplary embodiments of the present invention.

FIG. 3 illustrates an output circuit 300 according to an exemplary embodiment of the present invention. Referring to FIG. 3, the output circuit 300 includes a plurality of data lines D1 through Dn, a plurality of amplifiers 121 through 12*n*, a plurality of data line switches T1 through Tn, a plurality of first charge-share switches H1 through Hn, a plurality of second charge-share switches 311 through 31*z*, and a plurality of pads PAD1 through PADn, where "n" and "z" are natural numbers.

The amplifiers 121 through 12*n* amplify gray voltages V1 through Vn, respectively, and output the amplified gray voltages to the data lines D1 through Dn, respectively. Each of the data line switches T1 through Tn is switched at a first time point such that an output of a corresponding amplifier among the amplifiers 121 through 12*n* is transmitted to a corresponding data line among the data lines D1 through Dn.

The first charge-share switches H1 through Hn are connected between a share line Sh and the data lines D1 through Dn, respectively. Each of the second charge-share switches 311 through 31*z* is connected between two adjacent data lines, for example, D1 and D2 or Dn−1 and Dn, among the data lines D1 through Dn. For instance, the second charge-share switch, for example, 311 among the second charge-share switches 311 through 31*z* is connected between the odd numbered data line, for example, D1 and the even numbered data line, for example, D2, adjacent the odd numbered data line D1.

At a second time point, the data line switches T1 through Tn are turned off while the first charge-share switches H1 through Hn and the second charge-share switches 311 through 31*z* are turned on. In this exemplary embodiment, the second time point may be a charge-share point of a display panel (not shown). The pads PAD1 through PADn respectively connect the data lines D1 through Dn with source lines S1 through Sn.

Figure 4:
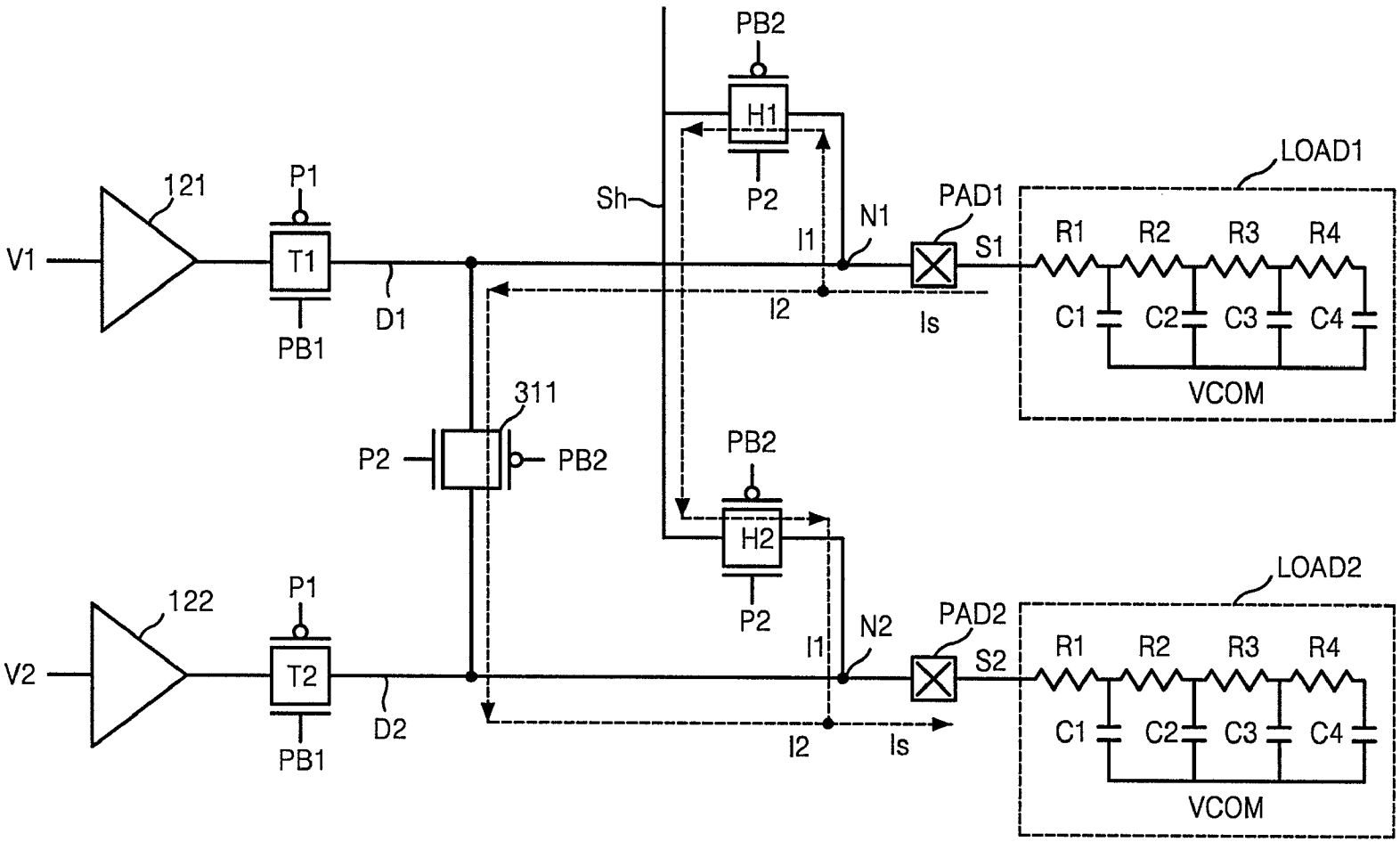
FIG. 4 illustrates a pair of adjacent output terminals respectively including adjacent data lines illustrated in FIG. 3 and loads in a display panel, which respectively correspond to the output terminals.

FIG. 4 illustrates a pair of the output terminals respectively including the adjacent data lines D1 and D2 illustrated in FIG. 3 and toads LOAD1 and LOAD2 in a display panel (not shown), which respectively correspond to the output terminals. In this exemplary embodiment, the toad LOAD1 is modeled of resistances R1 through R4 and capacitances C1 through C4 of the source line S1, and the load LOAD2 is modeled of resistances R1 through R4 and capacitances C1 through C4 of the source line S2.

Referring to FIGS. 3 and 4, the display panel is driven using a dot inversion method or a line inversion method, and the polarity of the first gray voltage V1 is opposite to that of the second gray voltage V2. For instance, the first gray voltage V1 may be a positive voltage and the second gray voltage V2 may be a negative voltage.

At the first time point, the data line switches T1 and T2 are turned on while the first charge-share switches H1 and H2 and the second charge-share switch 311 are turned off. At this time, the first gray voltage V1 amplified by the first amplifier 121 is applied to the first source line S1 via the first pad PAD1, and the second gray voltage V2 amplified by the second amplifier 122 is applied to the second source line S2 via the second pad PAD2. Corresponding cells among the plurality of cells in the display panel are charged based on the voltages V1 and V2 respectively applied to the first and second source lines S1 and S2.

At the second time point, for example, when the source lines S1 and S2 of the display panel are charge shared, the data line switches T1 and T2 are turned off while the first charge-share switches H1 and H2 and the second charge-share switch 311 are turned on. Accordingly, a charge-share current Is flows from the first source line S1 to the first pad PAD1. The charge-share current Is is divided into a first current I1 and a second current I2 at a first node N1.

As illustrated in FIG. 4, a first current I1 flows across the first charge-share switches H1 and H2, which are turned on. The first current I1 and the second current I2 are joined at a second node N2 and flow to the second source line S2 via the second pad PAD2.

Figure 2:
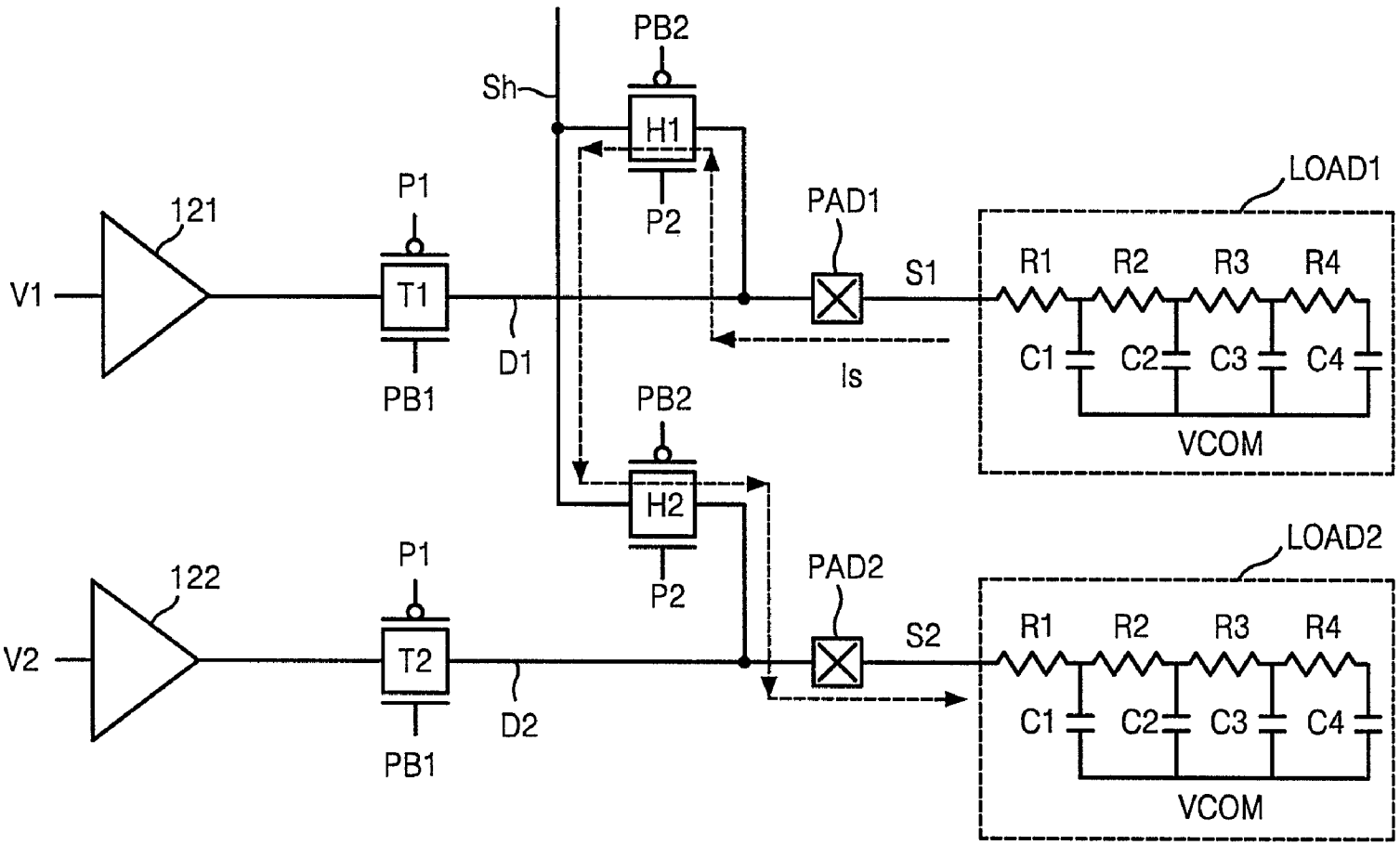
FIG. 2 (CONVENTIONAL ART)
FIG. 2 Illustrates a pair of adjacent output terminals illustrated in FIG. 1 and loads in a display panel which respectively correspond to the adjacent output terminals.

As illustrated in FIG. 4, the second current I2 flows from the first data line D1 to the second data line D2 and joins together with the first current I1 at the second node N2. During a charge-share between the source lines S1 and S2, the first current I1 divided from the charge-share current Is flows in the first charge-share switches H1 and H2. In other words, during the charge-share, a current, that is, the first current I1 flows in the charge-share switches, for example, H1 and H2, illustrated in FIG. 4 is smaller than the charge-share current Is flowing in the charge-share switches, for example, H1 and H2, illustrated in FIG. 2, thus, I1<Is. For example, when the current Is flowing during the charge-share is 10 mA, a current of 10 mA flows in the charge-share switches H1 and H2 illustrated in FIG. 2, while a current of 3 mA flows in the first charge-share switches H1 and H2 illustrated in FIG. 4 and a current 7 mA flows in the second charge-share switch 311 illustrated in FIG. 4. At this time, since the first charge-share switches H1 and H2 illustrated in FIG. 4 are connected in series during the charge-share, a current, that is, the second current I2, for example, 7 mA, flowing in the second charge-share switch 311 is greater than a current, that is, the first current I1, for example, 3 mA, flowing the first charge-share switches H1 and H2.

According to exemplary embodiments of the present invention, the amount of heat generated due to power consumed by way of charge-share currents, for example, I1=3 mA and I2=7 mA, in the output circuit 300 is reduced as compared to that in a conventional output circuit. Accordingly, the amount of heat generated during the charge-share due to the currents, for example, I1 and I2, flowing in the charge-share switches, for example, H1, H2, and 311, of the output circuit 300 can be reduced. When resistances decrease and capacitance increases in the loads LOAD1 and LOAD2 illustrated in FIG. 4, power consumed in the charge-share switches H1, H2, and 311 of the output circuit 300 decreases and, therefore, an effect of reducing the amount of heat will be enhanced.

Figure 5:
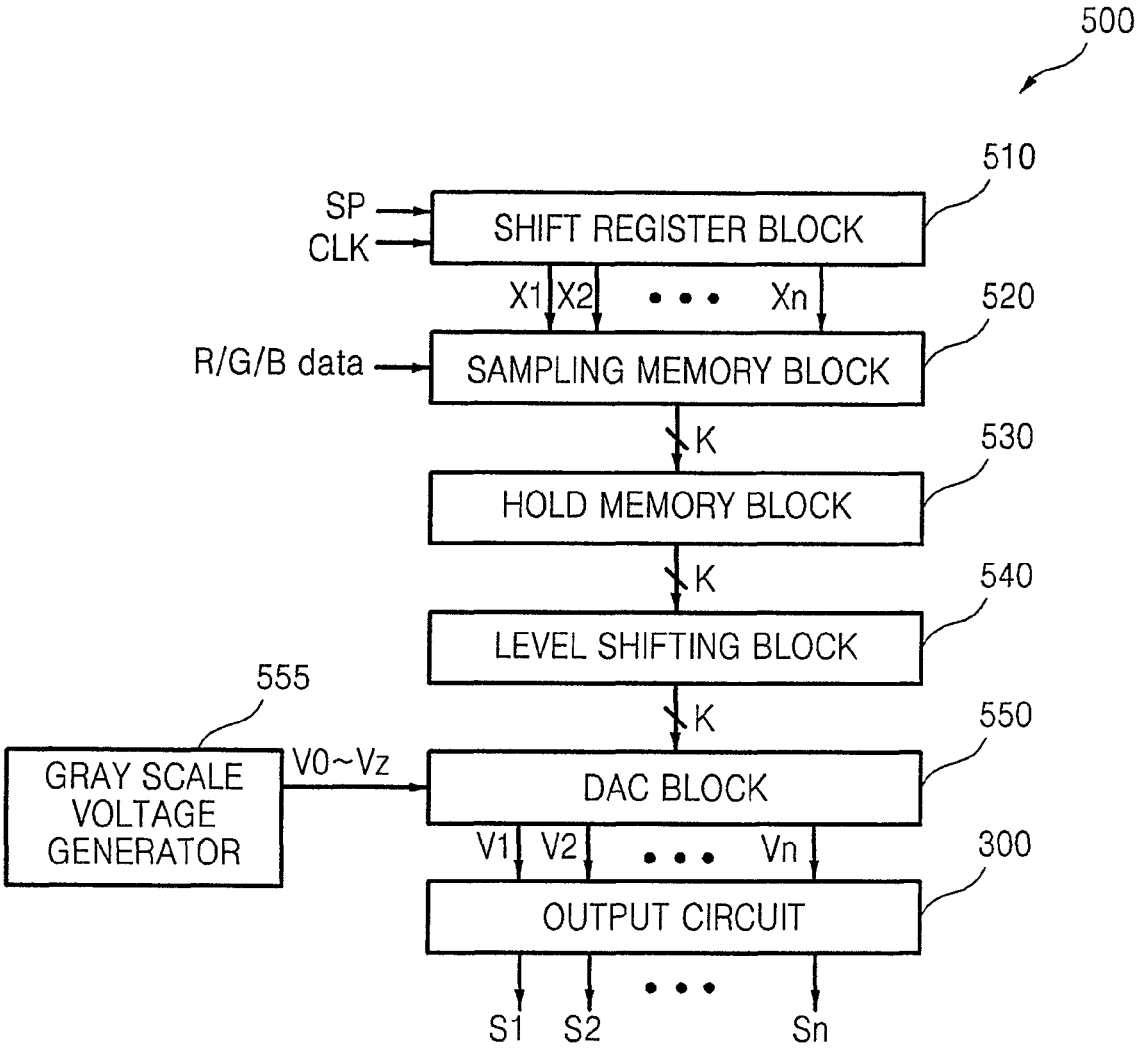
FIG. 5 illustrates a data driver device including the output circuit illustrated in FIG. 3, according to exemplary embodiments of the present invention.

FIG. 5 illustrates a data driver device 500 including the output circuit 300 illustrated in FIG. 3, according to an exemplary embodiment of the present invention. Referring to FIGS. 3 and 5, the data driver device 500 includes a shift register block 510, a sampling memory block 520, a hold memory block 530, a level shifting block 540, a gray voltage generator 555, a digital-to-analog converter (DAC) block 550, and the output circuit 300.

The shift register block 510 receives a clock signal CLK and a start pulse signal SP and shifts the start pulse signal SP in response to the clock signal CLK. The sampling memory block 520 samples input digital image data, for example, R/G/B data, in response to signals X1 through Xn output from the shift register block 510. The hold memory block 530 stores the sampled digital image data, for example, 6-bit R/G/B data, during a horizontal scan time. The level shifting block 540 shifts a voltage level of the digital image data stored in the hold memory block 530 and provides level-shifted digital image data to the DAC block 550. The DAC block 550 outputs one voltage from among gray voltages V0 through Vz, which are generated by the gray voltage generator 555, based on the level-shifted digital image data. When a dot inversion method or a line inversion method is used, the DAC block 550 may output a positive gray voltage and a negative gray voltage alternately to the data lines D1 through Dn of the output circuit 300 based on the digital image data.

As illustrated in FIG. 3, the output circuit 300 includes the data lines D1 through Dn, the amplifiers 121 through 12*n*, the data line switches T1 through Tn, the first charge-share switches H1 through Hn, the second charge-share switches 311 through 31*z*, and the pads PAD1 through PADn. The output circuit 300 receives positive gray voltages +V1 through +Vn or negative gray voltages −V1 through −Vn from the DAC block 550 and outputs drive signals to the source lines S1 through Sn. For instance, the data driver device 500 may drive an odd numbered source line, for example, Sn where "n" is an odd number, in the display panel (not shown) with a positive gray voltage and an even numbered source line, for example, Sn where "n" is an even number, in the display panel with a negative gray voltage. The output circuit 300 illustrated in FIG. 5 may be implemented by the structure illustrated in FIG. 3. Thus, a detailed description thereof will be omitted to avoid redundancy.

Figure 6:
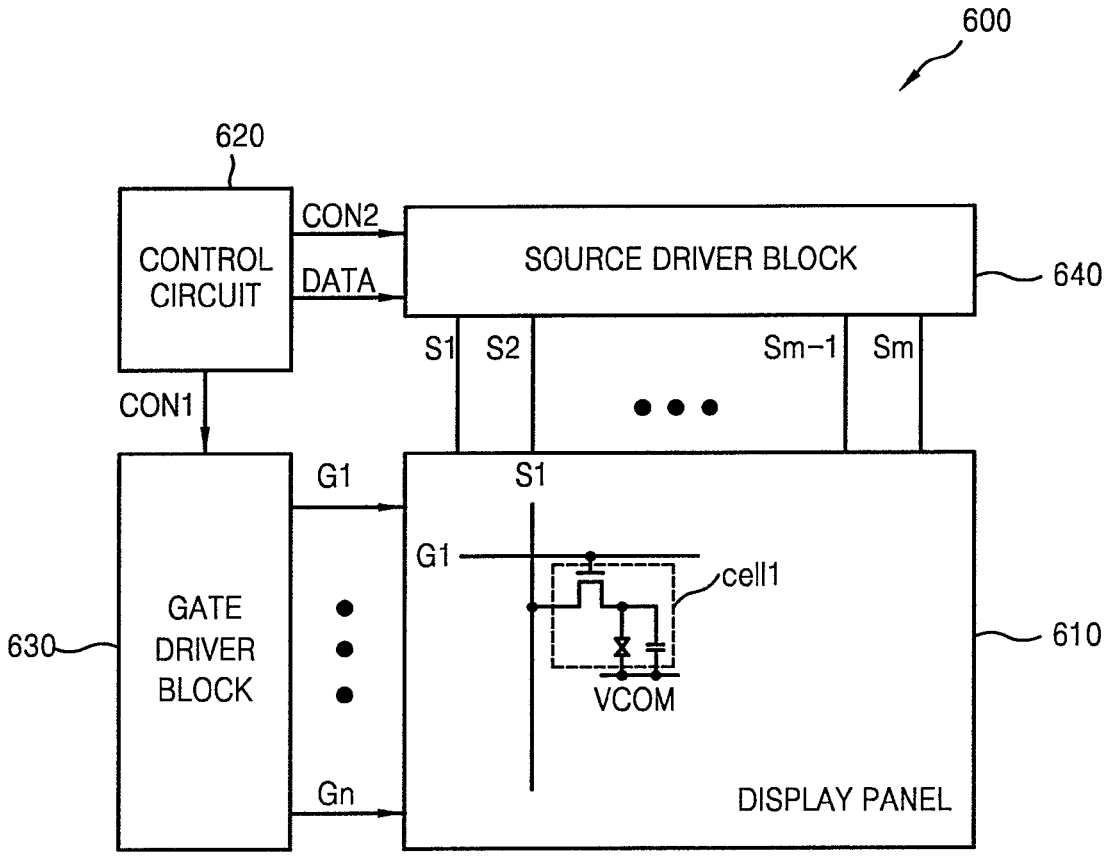
FIG. 6 illustrates a display device including the data driver device illustrated in FIG. 5, according to exemplary embodiments of the present invention.

FIG. 6 illustrates a display device 600 including a source driver employing the data driver device 500 illustrated in FIG. 5, according to an exemplary embodiment of the present invention. Referring to FIG. 6, the display device 600 includes a display panel 610, a control circuit 620, a gate driver block 630, and a source driver block 640.

The display panel 610, for example, a liquid crystal display (LCD) panel, includes a plurality of pixels, each having a structure like a cell 1 and a plurality of source lines S1 through Sm and a plurality of gate lines G1 through Gn. The gate driver block 630 sequentially drives the gate lines G1 through Gn in response to a first control signal CON1 output from the control circuit 620. The source driver block 640 may be implemented by a data driver device module including a plurality of data driver devices (not shown) and drives the source lines S1 through Sm, where "m" is a natural number, based on a second control signal CON2 and a digital image data DATA, which are output from the control circuit 620. Each of the data driver devices of the source driver may be implemented by the data driver device 500 illustrated in FIG. 5.

As described above, according to exemplary embodiments of the present invention, power consumption of charge-share switches in a data driver device is reduced during charge-share of a display panel and, therefore, the amount of heat generated due to power consumption of the charge-share switches can be reduced.

While the present invention has been shown and described with reference to exemplary embodiments thereof it will be understood by those of ordinary skill in the art that various changes in form and detail may be made herein without departing from the spirit and scope of the present invention, as defined by the following claims.

What is claimed is:

1. A data driver device comprising:

a plurality of data lines;

a plurality of first charge-share switches connected between a share line and the plurality of data lines, respectively, wherein a pair of the first charge-share switches are connected between adjacent data lines; and a plurality of second charge-share switches each connected in parallel to a pair of the first charge-share switches between the two adjacent data lines among the plurality of data lines.

2. The data driver device of claim 1, wherein the data driver device drives a plurality of source lines of a display panel using a dot inversion method, wherein the plurality of source lines are respectively connected with the plurality of data lines.

3. The data driver device of claim 2, further comprising a plurality of amplifiers, wherein each of the amplifiers amplifies a corresponding gray voltage among a plurality of gray voltages fed to the data driver and outputs the amplified gray voltage to a corresponding data line among the plurality of data lines.

4. The data driver device of claim 3, further comprising a plurality of data line switches, wherein each of the plurality of data line switches is switched to apply an output of a corresponding amplifier among the plurality of amplifiers to a corresponding data line among the plurality of data lines at a first time point.

5. The data driver device of claim 4, further comprising a digital-to-analog converter unit configured to output the plurality of gray voltages based on a digital image data signal fed thereto.

6. The data driver device of claim 5, further comprising a plurality of pads, wherein each of the pads connects a corresponding data line among the plurality of data lines with a corresponding source line among the plurality of source lines in the display panel.

7. The data driver device of claim 6, wherein the plurality of data line switches are turned off and the plurality of first charge-share switches and the plurality of second charge-share switches are turned on at a second time point.

8. The data driver device of claim 7, wherein the plurality of data line switches are transmission gates that are switched in response to a first control signal and a first inversion control signal, and wherein the plurality of first charge-share switches and the plurality of second charge-share switches are transmission gates that are switched alternately with the plurality of data line switches in response to a second control signal and a second inversion control signal.

9. A data driver device comprising:

a plurality of data lines each of which outputs a corresponding gray voltage among a plurality of gray voltages to a corresponding source line among a plurality of source lines included in a display panel, wherein there are two parallel electrical paths including first and second charge-share switches formed between each two adjacent data lines among the plurality of data lines while the source lines are charge shared.

10. A data driver device module comprising a plurality of data driver devices each comprising:

a data driver device comprising:

a plurality of data lines;

a plurality of first charge-share switches connected between a share line and the plurality of data lines, respectively, wherein a pair of the first charge-share switches are connected between adjacent data lines; and a plurality of second charge-share switches each connected in parallel to a pair of the first charge-share switches between the two adjacent data lines among the plurality of data lines.

11. A display device comprising:

a display panel having a plurality of gate lines, a plurality of source lines, and a plurality of pixels;

a gate driver configured to drive the plurality of gate lines; and a plurality of data driver devices configured to drive the plurality of source lines, wherein each of the data driver devices comprises:

a digital-to-analog converter unit configured to output a plurality of gray voltages based on a digital image data signal; and an output circuit configured to output the plurality of gray voltages to the respective plurality of source lines, and wherein the output circuit comprises:

a plurality of data lines;

a plurality of first charge-share switches connected between a share line and the plurality of data lines, respectively, wherein a pair of the first charge-share switches are connected between adjacent data lines; and a plurality of second charge-share switches each connected in parallel to a pair of the first charge-share switches between the two adjacent data lines among the plurality of data lines.

12. The display device of claim 11, wherein the display panel drives the plurality of source lines in the display panel using a dot inversion method, wherein each of the plurality of source lines is connected with a corresponding data line among the plurality of data lines, using a dot inversion method.

13. The display device of claim 12, wherein the output circuit further comprises:

a plurality of amplifiers each of which amplifies a corresponding gray voltage among a plurality of gray voltages and outputs the amplified gray voltage to a corresponding data line among the plurality of data lines;

a plurality of data line switches each of which is switched to apply an output of a corresponding amplifier among the plurality of amplifiers to a corresponding data line among the plurality of data lines at a first time point; and a plurality of pads each of which connects a corresponding data line among the plurality of data lines with a corresponding source line among the plurality of source lines in the display panel.

* * * * *